US007863830B2

(12) United States Patent
Schemmel et al.

(10) Patent No.: US 7,863,830 B2
(45) Date of Patent: Jan. 4, 2011

(54) ELECTRONIC BALLAST AND METHOD FOR OPERATING AN ELECTRIC LAMP

(75) Inventors: Bernhard Schemmel, Wessling (DE); Kay Schmidtmann, München (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 464 days.

(21) Appl. No.: 12/083,574

(22) PCT Filed: Oct. 12, 2006

(86) PCT No.: PCT/EP2006/067359

§ 371 (c)(1),
(2), (4) Date: Apr. 15, 2008

(87) PCT Pub. No.: WO2007/045604

PCT Pub. Date: Apr. 26, 2007

(65) Prior Publication Data

US 2009/0267518 A1 Oct. 29, 2009

(30) Foreign Application Priority Data

Oct. 17, 2005 (DE) ..... 10 2005 049 583

(51) Int. Cl.
*H05B 37/00* (2006.01)

(52) U.S. Cl. ..... 315/291; 315/307; 315/309

(58) Field of Classification Search ..... 315/307, 315/219, 291, 237, 238, 244, DIG. 5, DIG. 7, 315/227 R, 309
See application file for complete search history.

(56) References Cited

U.S. PATENT DOCUMENTS

| | | | | |
|---|---|---|---|---|
| 5,668,446 | A | 9/1997 | Baker | |
| 6,348,769 | B1 | 2/2002 | Pinchuk et al. | |
| 6,943,502 | B2 * | 9/2005 | Yamanaka et al. | 315/224 |
| 7,279,853 | B2 * | 10/2007 | Chong | 315/307 |
| 2002/0011791 | A1 | 1/2002 | Nakagawa et al. | |

FOREIGN PATENT DOCUMENTS

| | | | |
|---|---|---|---|
| DE | 199 61 102 | A1 | 7/2000 |
| GB | 2 337 644 | A | 11/1999 |

* cited by examiner

*Primary Examiner*—David Hung Vu

(57) ABSTRACT

The invention relates to an electronic ballast device for operating an electric lamp (2), comprising a first (21) and a second lamp filament (22), wherein the lamp filaments (21, 22) are electrically connected to a heating circuit (3) during a pre-warming phase for the electric lamp (2) said heating circuit (3) being of such a form that the heating current generated by the heating circuit (3) during an operational phase of the electric lamp (2) amounts to between 20% and 60% of the lamp current of said electric lamp (2). The invention further relates to a method for operation of an electric lamp with an electronic ballast device.

19 Claims, 1 Drawing Sheet

ELECTRONIC BALLAST AND METHOD FOR OPERATING AN ELECTRIC LAMP

TECHNICAL FIELD

The present invention relates to an electronic ballast for operating an electric lamp, which has a first and a second lamp filament, the lamp filaments being electrically connected to a heating circuit of the electronic ballast for heating purposes during a preheating phase of the electric lamp. The invention also relates to a method for operating an electric lamp with such an electronic ballast.

PRIOR ART

A variety of designs and different types of electric lamps are known. As a result of this variety, a large number of different electronic ballasts are also known. The large number of different electric lamps, such as gas discharge lamps, for example low-pressure discharge lamps, require different operating conditions and therefore also different electronic ballasts.

An electric lamp which is likewise already known is the amalgam fluorescent lamp. This has an advantage to the extent that the luminous flux is above 90% in a broad temperature range. This positive effect of the amalgam fluorescent lamps which can occur to a lesser or greater extent depending on the design of this lamp can be reduced significantly by a heating circuit for heating the lamp filaments of this lamp in an operating phase. This heating circuit is arranged in the electronic ballast with which the corresponding electric lamp is operated. As a result of such a heating circuit, which has a negative influence on the luminous flux of the amalgam fluorescent lamp in the operating phase, the luminous flux of such amalgam fluorescent lamps in the upper temperature range is reduced much earlier than in the case of an electronic ballast which is considered as a reference.

In order to be able to reduce this negative effect as a result of the heating circuit for heating the lamp filaments, heating circuits are known which can be switched off during the operating phase, but which can only be realized by means of a very complex and therefore also cost-intensive solution.

Until now, it has only been possible to utilize the entirely positive effect in the case of amalgam fluorescent lamps when the electronic ballast does not pass any additional heating current through the lamp filaments during the operating phase of the electric lamp; i.e. the heating circuit (preheating) is disconnected completely in the operating phase of the electric lamp. The complex circuitry concept already mentioned above for this purpose requires a complex additional circuit with a heating circuit which can be disconnected. For this purpose, it is generally necessary to use a dedicated heating transformer, which can be switched on and off via a switchable element.

DESCRIPTION OF THE INVENTION

The present invention is therefore based on the object of providing an electronic ballast in the case of which the negative influence of a heating circuit for heating the lamp filaments of an electric lamp in the operating phase of the electric lamp can at least be reduced. In particular, it is the object to at least be able to reduce the abovementioned disadvantage in the case of amalgam fluorescent lamps.

This object is achieved by an electronic ballast which has the features as claimed in patent claim 12 and a method which has the features as claimed in patent claim 10.

A ballast according to the invention for operating an electric lamp comprises a heating circuit, which is designed to heat lamp filaments of the electric lamp during a preheating phase. The lamp filaments are electrically connected to the heating circuit. An essential concept of the invention consists in the fact that the heating circuit is designed in such a way that the heating current produced by this heating circuit in an operating phase of the electric lamp can be dimensioned to have a value of between 20% and 60% of the lamp current of the electric lamp. The operating phase chronologically follows the preheating phase and the ignition of the electric lamp. As a result of the reduction in the heating current to a fraction of the lamp current in the operating phase of the electric lamp it is possible to achieve the situation in which a very high luminous flux can be provided even at relatively high temperatures which occur in the operating phase of the electric lamp. With the electronic ballast according to the invention it is therefore no longer necessary to completely disconnect the heating circuit during the operating phase of the electric lamp and it is therefore also no longer necessary to have to provide a complex circuitry concept for this purpose. As a result of the fact that the heating current is markedly reduced in comparison with the preheating phase during the operating phase and in terms of proportions is set in the range between 20% and 60% of the lamp current, it is possible to take into account the fact that a relatively high luminous flux is achieved over a wide temperature range during the operating phase of the electric lamp. Preferably, the heating circuit is designed in such a way that, in a preheating phase, it has a state of resonance which ensures relatively high heating currents, the high heating currents being reduced in an operating phase. The heating circuit then no longer has a state of resonance in the operating phase.

In a preferred manner, the heating current produced by the heating circuit in the operating phase of the electric lamp can be dimensioned to have a value of between 33% and 53% of the lamp current of the electric lamp. Advantageously, the value which can be set in the operating phase is between 37% and 48% of the lamp current of the electric lamp. These reductions in the mentioned intervals make a further improvement possible in terms of achieving a luminous flux which is as high as possible with little complexity in terms of circuitry.

Advantageously, the heating circuit has a first inductance as the lamp inductor and a first and a second additional inductance, the first additional inductance being electrically connected to a first end of the first lamp filament, and the second additional inductance being electrically connected to a first end of the second lamp filament.

Advantageously, a resonant circuit is connected at least between the first additional inductance and the first end of the first lamp filament. Preferably, the resonant circuit, in the case of operating conditions to be set, in a preheating phase of the electric lamp, essentially has a state of resonance. The resonant circuit, in the case of operating conditions to be set, in the operating phase of the electric lamp, has an operating state which is different than the preheating phase. In particular, it is advantageous if the resonant circuit has a state of non-resonance in the operating phase of the electric lamp. This means that a maximum heating current can be emitted to the lamp filaments only in the preheating phase as a result of the state of resonance which is achieved there. In the transition from the preheating phase to the operating phase in which the operating frequency, which can be greater than 70 kHz in the preheating phase, is also reduced to a lower value, the resonant circuit also assumes an operating state which is far from the state of resonance. As a result, the heating current emitted to the lamp filaments is markedly reduced.

The operating conditions which are conventional during the preheating phase and the operating phase for proper and safe operation and the settings required for this are meant by and included in the operating conditions to be set.

During the operating phase, the resonant circuit and therefore also the entire heating circuit is out of resonance and the influence on the luminous flux of the electric lamp at high temperatures in the operating phase can be markedly reduced, in the optimum case even prevented.

The resonant circuit preferably comprises a heating inductance and a heating capacitor, which are connected in series. It is preferred if the resonant circuit is designed in such a way that in each case one series circuit comprising a heating inductance and a heating capacitor is connected between the two additional inductances and the corresponding ends of the lamp filaments. Given a quasi symmetric configuration, a series circuit comprising a heating capacitor and a heating inductance is therefore in each case connected at the first ends of the lamp filaments. The heating circuit can therefore be tuned effectively in a preheating phase and in an operating phase.

In a particularly preferred embodiment, the electric lamp is in the form of an amalgam fluorescent lamp. In the case of such a configuration of the electric lamp, precisely in this case the very positive amalgam effect (approximately 90% of the luminous flux over a wide temperature range) can be used in optimum fashion and the negative influence of the heating circuit in the operating phase markedly reduced.

In a method according to the invention for operating an electric lamp with an electronic ballast, which has a heating circuit for heating at least one filament of the electric lamp, the heating current of the heating circuit during an operating phase of the electric lamp is set to a value of between 20% and 60% of the lamp current of the electric lamp.

Advantageous configurations of the electronic ballast, where transferable, can also be regarded as advantageous configurations of the method according to the invention.

BRIEF DESCRIPTION OF THE DRAWING(S)

An exemplary embodiment of the present invention will be explained in more detail below with reference to the attached schematic drawings, in which.

PREFERRED EMBODIMENT OF THE INVENTION

Figure 1:
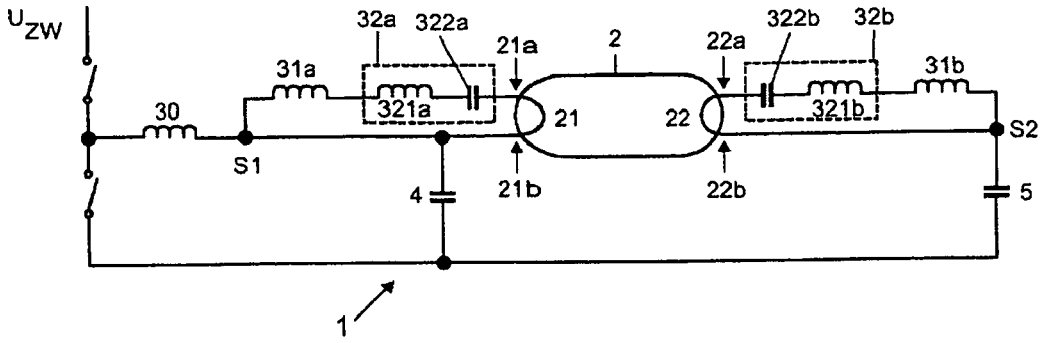
FIG. 1 shows an electronic ballast according to the invention.

FIG. 1 shows an electronic ballast 1 according to the invention for operating an electric lamp 2, which in the exemplary embodiment is in the form of an amalgam fluorescent lamp. The electric lamp 2 has a first lamp filament 21 and a second lamp filament 22. Both the first lamp filament 21 and the second lamp filament 22 each comprise a first end 21*a* and 22*a* and a second end 21*b* and 22*b*, respectively.

Furthermore, the electronic ballast 1 has a heating circuit 3 for heating the two lamp filaments 21 and 22 during a preheating phase of the electric lamp 2. The heating circuit 3 is electrically connected both to the first lamp filament 21 and to the second lamp filament 22.

As illustrated in FIG. 1, the heating circuit 3 comprises a lamp inductor, which is in the form of a first inductance 30. This inductance 30 is electrically connected to a first circuit node S1. Furthermore, the heating circuit 3 comprises a first additional inductance 31*a* and a second additional inductance 31*b*. As can be seen, the first additional inductance 31*a* is likewise connected to the first circuit node S1. Furthermore, the first additional inductance 31*a* is connected into a circuit branch, electrical contact being made between said circuit branch and the first end 21*a* of the first lamp filament 21.

Furthermore, the second additional inductance 31*b* is connected to a second circuit node S2 and is connected into a circuit branch, electrical contact being made between said circuit branch and the first end 22*a* of the second lamp filament 22.

As is shown in the exemplary embodiment in FIG. 1, the heating circuit 3 comprises a resonant circuit 32*a* and 32*b*, the resonant circuit 32*a* being connected between the first additional inductance 31*a* and the first end 21*a* of the first lamp filament 21. The resonant circuit 32*a* comprises a heating inductance 321*a* and a heating capacitor 322*a*, which is connected in series therewith. In an analogous and symmetric manner, a corresponding resonant circuit 32*b*, which likewise has a heating inductance 321*b* and a heating capacitor 322*b* in a series circuit, is connected between the second additional inductance 31*b* and the first end 22*a* of the second lamp filament 22. In the exemplary embodiment, the circuits 32*a* and 32*b* can be considered to be a single common resonant circuit.

As can furthermore be seen from the illustration in FIG. 1, in the exemplary embodiment electrical contact is made between a resonant capacitor 4 and the second end 21*b* of the first lamp filament 21. Furthermore, a coupling capacitor 5 is electrically connected to the resonant capacitor 4, on the one hand, and to the second circuit node S2, on the other hand. The voltage supply takes place via the intermediate circuit voltage $U_{ZW}$. The circuit arrangement shown in FIG. 1 is merely by way of example and can be configured in a variety of ways in order to be able to achieve the reduction in the heating current in the operating phase in comparison with the preheating phase.

In terms of the provision of a very high luminous flux over a wide temperature range even during the operating phase of the electric lamp 2, the resonant circuits 32*a* and 32*b*, in particular the physical parameters of the component parts 321*a*, 322*a* and 321*b*, 322*b*, are designed in such a way that, in the preheating phase of the electric lamp, a state of resonance is set and therefore also the heating circuit 3 is essentially in a state of resonance. As a result, it is possible to achieve a situation in which a very high heating current can be emitted to the two lamp filaments 21 and 22. In the transition from the preheating phase to the operating phase of the electric lamp 2, the operating frequency is reduced, as a result of which the resonant circuits 32*a* and 32*b* leave the state of resonance assumed in the preheating phase and enter an operating state which is markedly different than the state of resonance. As a result, the tuning of the heating circuit 3 is changed to the extent that a markedly reduced current is emitted to the lamp filaments 21 and 22 in the operating phase. The heating circuit 3 is configured in accordance with the invention in such a way that, during this operating phase, the heating current produced by this heating circuit 3 has a value which, in terms of proportion, is between 20% and 60% of the lamp current of the electric lamp 2. Preferably, this value is between 33% and 53% of the lamp current. In a further advantageous configuration, this value can be between 37% and 48% of the lamp current, as a result of which, in the case of each interval, in each case a further improvement can be achieved to the extent that a very high luminous flux can be provided over a wide temperature range.

Figure 2:
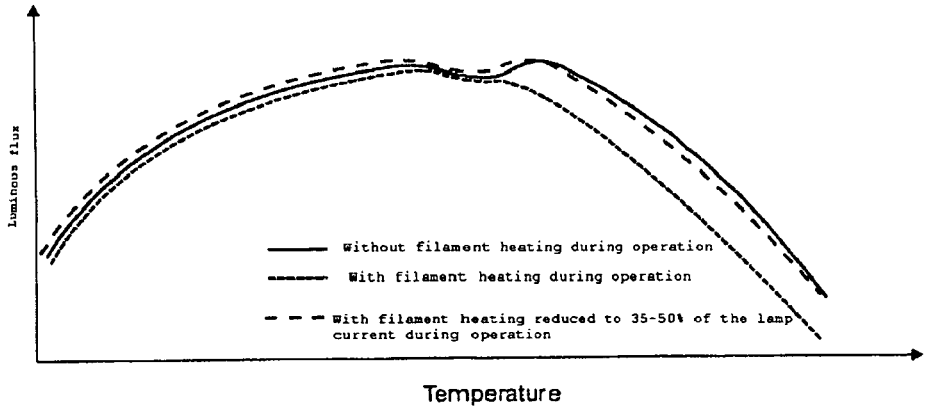
FIG. 2 shows an illustration of the luminous flux of an amalgam fluorescent lamp as a function of temperature.

FIG. 2 illustrates schematically the dependence of the luminous flux of the electric lamp 2, which is in the form of an amalgam fluorescent lamp in the exemplary embodiment, on temperature. As can be seen from the graph, the luminous flux at relatively high temperatures in the case of a design with disconnected filament heating or a disconnected heating circuit 3 (continuous line) in the operating phase of the electric lamp 2 has essentially the same profile as a luminous flux curve in accordance with the invention (dashed curve), in which, during the operating phase of the electric lamp 2, a reduction in the heating current to a corresponding fraction of the lamp current is carried out. Furthermore, it can be seen from the graph that as a result of the invention a marked improvement in the luminous flux profile, in particular at high temperatures, can be achieved in comparison with a configuration in which, during the operating phase of the electric lamp 2, the filament heating or the heating circuit 3 is operated completely and therefore virtually without any reduced heating current emission (dotted line).

The invention claimed is:

1. An electronic ballast for operating an electric lamp (2), which has a first (21) and a second lamp filament (22), the lamp filaments (21, 22) being electrically connected to a heating circuit (3) for heating purposes, characterized in that the electric lamp (2) is in the form of an amalgam fluorescent lamp, the heating circuit (3) is designed in such a way that the heating current produced by this heating circuit (3) in an operating phase of the electric lamp (2) can be dimensioned to have a value of between 20% and 60% of the lamp current of the electric lamp (2).

2. The electronic ballast as claimed in claim 1, characterized in that the heating current produced by the heating circuit (3) in the operating phase of the electric lamp (2) can be dimensioned to have a value of between 33% and 53% of the lamp current of the electric lamp (2).

3. The electronic ballast as claimed in claim 1, characterized in that the heating current produced by the heating circuit (3) in the operating phase of the electric lamp (2) can be dimensioned to have a value of between 37% and 48% of the lamp current of the electric lamp (2).

4. The electronic ballast as claimed in claim 1, characterized in that the heating circuit (3) has a first inductance (30) as the lamp inductor and a first (31*a*) and a second additional inductance (31*b*), the first additional inductance (31*a*) being electrically connected to a first end (21*a*) of the first lamp filament (21), and the second additional inductance (31*b*) being electrically connected to a first end (22*a*) of the second lamp filament (22).

5. The electronic ballast as claimed in claim 4, characterized in that a resonant circuit (32*a*; 32*b*) is connected at least between the first additional inductance (31*a*) and the first end (22*a*) of the first lamp filament (21).

6. The electronic ballast as claimed in claim 5, characterized in that the resonant circuit (32*a*; 32*b*), in the case of operating conditions to be set, in a preheating phase of the operation of the electric lamp (2), essentially has a state of resonance.

7. The electronic ballast as claimed in claim 5, characterized in that the resonant circuit (32*a*; 32*b*), in the case of operating conditions to be set, in the operating phase of the electric lamp (2), has an operating state which is different from the operating state in the preheating phase.

8. The electronic ballast as claimed in claim 5, characterized in that the resonant circuit (32*a*; 32*b*) has at least one heating inductance (321*a*; 321*b*) and a heating capacitor (322*a*; 322*b*), which are connected in series.

9. The electronic ballast as claimed in claim 5, characterized in that the resonant circuit (32a; 32b) is designed in such a way that in each case one series circuit comprising a heating inductance (321*a*; 321*b*) and a heating capacitor (322*a*; 322*b*) is connected between the two additional inductances (31*a*; 31*b*) and the corresponding ends (21*a*; 22*a*) of the lamp filaments (21, 22).

10. A method for operating an electric lamp (2) with an electronic ballast (1), which has a heating circuit (3) for heating at least one lamp filament (21, 22) of the electric lamp (2), characterized in that the heating current of the heating circuit (3) during an operating phase of the electric lamp (2) is dimensioned to have a value of between 20% and 60% of the lamp current of the electric lamp (2).

11. The electronic ballast as claimed in claim 2, characterized in that the heating current produced by the heating circuit (3) in the operating phase of the electric lamp (2) can be dimensioned to have a value of between 37% and 48% of the lamp current of the electric lamp (2).

12. The electronic ballast as claimed in claim 2, characterized in that the heating circuit (3) has a first inductance (30) as the lamp inductor and a first (31*a*) and a second additional inductance (31*b*), the first additional inductance (31*a*) being electrically connected to a first end (21*a*) of the first lamp filament (21), and the second additional inductance (31*b*) being electrically connected to a first end (22*a*) of the second lamp filament (22).

13. The electronic ballast as claimed in claim 3, characterized in that the heating circuit (3) has a first inductance (30) as the lamp inductor and a first (31*a*) and a second additional inductance (31*b*), the first additional inductance (31*a*) being electrically connected to a first end (21*a*) of the first lamp filament (21), and the second additional inductance (31*b*) being electrically connected to a first end (22*a*) of the second lamp filament (22).

14. The electronic ballast as claimed in claim 6, characterized in that the resonant circuit (32*a*; 32*b*), in the case of operating conditions to be set, in the operating phase of the electric lamp (2), has an operating state which is different than the operating state in the preheating phase.

15. The electronic ballast as claimed in claim 6, characterized in that the resonant circuit (32*a*; 32*b*) has at least one heating inductance (321*a*; 321*b*) and a heating capacitor (322*a*; 322*b*), which are connected in series.

16. The electronic ballast as claimed in claim 7, characterized in that the resonant circuit (32*a*; 32*b*) has at least one heating inductance (321*a*; 321*b*) and a heating capacitor (322*a*; 322*b*), which are connected in series.

17. The electronic ballast as claimed in claim 6, characterized in that the resonant circuit (32*a*; 32*b*) is designed in such a way that in each case one series circuit comprising a heating inductance (321*a*; 321*b*) and a heating capacitor (322*a*; 322*b*) is connected between the two additional inductances (31*a*; 31*b*) and the corresponding ends (21*a*; 22*a*) of the lamp filaments (21, 22).

18. The electronic ballast as claimed in claim 7, characterized in that the resonant circuit (32*a*; 32*b*) is designed in such a way that in each case one series circuit comprising a heating inductance (321*a*; 321*b*) and a heating capacitor (322*a*; 322*b*)

is connected between the two additional inductances (31*a*; 31*b*) and the corresponding ends (21*a*; 22*a*) of the lamp filaments (21, 22).

19. The electronic ballast as claimed in claim 8, characterized in that the resonant circuit (32*a*; 32*b*) is designed in such a way that in each case one series circuit comprising a heating inductance (321*a*; 321*b*) and a heating capacitor (322*a*; 322*b*) is connected between the two additional inductances (31*a*; 31*b*) and the corresponding ends (21*a*; 22*a*) of the lamp filaments (21, 22).

* * * * *